US010144606B2

(12) United States Patent
Alletto, Jr.

(10) Patent No.: US 10,144,606 B2
(45) Date of Patent: Dec. 4, 2018

(54) PILLOW NAPKIN DISPENSING SYSTEM AND METHOD

(71) Applicant: BEDGEAR, LLC, Farmingdale, NY (US)

(72) Inventor: Eugene Alletto, Jr., Glen Head, NY (US)

(73) Assignee: BEDGEAR, LLC, Farmingdale, NY (US)

( * ) Notice: Subject to any disclaimer, the term of this patent is extended or adjusted under 35 U.S.C. 154(b) by 0 days.

(21) Appl. No.: 15/800,569

(22) Filed: Nov. 1, 2017

(65) Prior Publication Data

US 2018/0049566 A1 Feb. 22, 2018

Related U.S. Application Data

(63) Continuation of application No. 15/589,282, filed on May 8, 2017, now Pat. No. 9,877,603, which is a (Continued)

(51) Int. Cl.
*A47G 9/10* (2006.01)
*B65H 16/00* (2006.01)
(Continued)

(52) U.S. Cl.
CPC ..... *B65H 16/005* (2013.01); *A47C 9/10* (2013.01); *A47C 21/028* (2013.01); *A47F 5/0025* (2013.01); *A47F 5/108* (2013.01); *A47F 7/30* (2013.01); *A47F 10/02* (2013.01); *A47G 9/0253* (2013.01); *A47G 9/10* (2013.01); *A47G 9/1054* (2013.01); *A47K 10/38* (2013.01); *B65D 83/0811* (2013.01); *B65H 75/185* (2013.01); *A47B 81/00* (2013.01); *B65H 9/00* (2013.01);
(Continued)

(58) Field of Classification Search
CPC ..... A47F 10/02; A47G 9/10; A47G 9/0253; A47G 9/02; A47K 10/38; A47C 9/10
See application file for complete search history.

(56) References Cited

U.S. PATENT DOCUMENTS 1,036,066 A 8/1912 Bown
1,275,205 A 8/1918 Bigham et al.
(Continued)

FOREIGN PATENT DOCUMENTS

DE 10 2009 020 871 A1 12/2009 ..... B60N 2/44

OTHER PUBLICATIONS

"Starting a pillow store," gaebler.com, Jun. 2013, (5 pages).

*Primary Examiner* — Mark J Beauchaine
(74) *Attorney, Agent, or Firm* — Sorell, Lenna & Schmidt, LLP

(57) ABSTRACT

A dispenser for pillow napkins is provided that includes a carton having a bottom panel, opposite left and right panels extending vertically from the bottom panel, opposite front and back panels positioned between the left and right panels and extending vertically from the bottom panel, and a top panel extending parallel to the bottom panel. Left and right supports are positioned within a cavity of the carton. A plurality of pillow napkins are wound about a spool. The spool is positioned in the cavity such that the spool rotatably engages the left and right supports and the pillow napkins are spaced apart from the top and bottom panels. Methods of use are provided.

20 Claims, 10 Drawing Sheets

Related U.S. Application Data continuation of application No. 15/466,259, filed on Mar. 22, 2017, which is a continuation of application No. 14/864,074, filed on Sep. 24, 2015, now Pat. No. 9,635,961, which is a continuation of application No. 14/061,950, filed on Oct. 24, 2013, now Pat. No. 9,386,868.

(51) Int. Cl.

| | |
|---|---|
| ***A47K 10/38*** | (2006.01) |
| ***A47C 21/02*** | (2006.01) |
| ***B65D 83/08*** | (2006.01) |
| ***A47G 9/02*** | (2006.01) |
| ***A47F 5/00*** | (2006.01) |
| ***A47F 5/10*** | (2006.01) |
| ***A47F 7/30*** | (2006.01) |
| ***B65H 75/18*** | (2006.01) |
| ***A47F 10/02*** | (2006.01) |
| ***A47C 9/10*** | (2006.01) |
| *A47B 81/00* | (2006.01) |
| *B65H 23/00* | (2006.01) |
| *B65H 9/00* | (2006.01) |

(52) U.S. Cl.

CPC ..... *B65H 23/00* (2013.01); *B65H 2701/191* (2013.01)

(56) References Cited

U.S. PATENT DOCUMENTS 1,772,438 A 8/1930 Cubberley
2,537,741 A 1/1951 Clark
2,575,661 A 11/1951 Hickey
2,696,419 A 12/1954 Wallance et al.
2,827,141 A 3/1958 Kessler
2,868,391 A 1/1959 Sides
3,467,258 A 9/1969 Larsen
3,495,845 A 2/1970 Jensen
3,581,935 A 6/1971 Chi
3,701,522 A 10/1972 Chi
4,019,793 A 4/1977 Gerding
4,066,022 A 1/1978 Graves
4,309,784 A 1/1982 Cohen
4,410,093 A 10/1983 Chiarello et al.
4,624,021 A 11/1986 Hofstetter
4,725,066 A 2/1988 Nootenboom et al.
4,731,890 A 3/1988 Roberts
4,754,510 A 7/1988 King
4,826,020 A 5/1989 Davis
4,832,271 A 5/1989 Gelezlunas
4,858,259 A 8/1989 Simmons et al.
4,876,835 A 10/1989 Kelley et al.
4,905,947 A * 3/1990 Henne ..... A47F 5/112 248/152
4,958,841 A 9/1990 Keen
5,076,424 A 12/1991 Nakamura
5,148,706 A 9/1992 Masuda et al.
5,167,377 A 12/1992 Chalmers
5,314,243 A 5/1994 McDonald et al.
5,380,079 A 1/1995 Hamilton
5,533,459 A 7/1996 Fontana
5,540,354 A 7/1996 Annand
5,718,441 A 2/1998 Kern
5,727,266 A 3/1998 Pang
5,805,455 A 9/1998 Lipps
5,848,798 A 12/1998 Halvorson, Jr. et al.
5,991,945 A 11/1999 Pang
6,119,736 A 9/2000 Huang et al.
6,119,873 A 9/2000 Matthews
6,125,488 A 10/2000 Vogland et al.
6,173,458 B1 * 1/2001 Maddux ..... A47K 1/02 4/619
6,196,435 B1 3/2001 Wu
6,308,837 B1 10/2001 Bragg et al.
6,390,428 B1 5/2002 Oshima
6,557,325 B1 5/2003 Katz
6,571,192 B1 5/2003 Hinshaw et al.
6,585,328 B1 7/2003 Oexman et al.
6,741,950 B2 5/2004 Hinshaw et al.
6,760,643 B2 7/2004 Lipps
6,760,935 B1 * 7/2004 Burton ..... A47G 9/10 5/636
6,814,535 B1 11/2004 Maness
6,981,288 B1 1/2006 Hu
6,988,286 B2 1/2006 Schecter ..... A47G 9/10 5/645
6,997,070 B2 2/2006 Killingbeck
7,124,652 B2 10/2006 Killingbeck
7,159,726 B1 1/2007 Stenton
7,467,058 B2 12/2008 Boyd
7,516,569 B2 4/2009 Garcia
7,523,046 B2 4/2009 Colalancia et al.
7,523,513 B2 4/2009 Waters et al.
7,600,335 B2 10/2009 Suprina
7,707,661 B2 5/2010 Issachar
7,726,735 B2 6/2010 Resendez
RE41,809 E 10/2010 Hinshaw et al.
7,877,916 B2 2/2011 Chamandy
7,937,238 B2 5/2011 Boyd
7,937,239 B2 5/2011 Boyd
7,950,537 B1 5/2011 Goodman et al.
8,015,640 B2 9/2011 Sun
8,075,004 B2 12/2011 Abel et al.
8,094,043 B2 1/2012 Calhoun et al.
8,117,700 B2 2/2012 Howard
8,171,601 B1 5/2012 Yurkon
8,195,328 B2 6/2012 Mallet et al.
8,231,016 B2 7/2012 Berdahl et al.
8,255,291 B1 8/2012 Nair
D672,183 S 12/2012 Alletto, Jr.
8,387,787 B1 3/2013 Cvjetkovic et al.
8,501,259 B2 8/2013 Vergara
2002/0149176 A1 10/2002 Miller
2003/0129904 A1 7/2003 Wolynes et al.
2003/0188383 A1 10/2003 Ense
2004/0201204 A1 10/2004 Haire
2005/0035198 A1 2/2005 Wilensky
2005/0055917 A1 3/2005 Dubensky
2005/0212241 A1 9/2005 Stone
2005/0257410 A1 11/2005 Horowitz et al.
2006/0059756 A1 3/2006 Wells
2006/0076810 A1 4/2006 Nichols
2006/0125356 A1 6/2006 Meek, Jr. et al.
2006/0230992 A1 10/2006 Newhouse et al.
2006/0231517 A1 10/2006 Bothun et al.
2006/0266770 A1 11/2006 Fitzgerald
2007/0052333 A1 3/2007 Freire
2007/0221194 A1 9/2007 Bruno et al.
2007/0295681 A1 12/2007 Colin
2008/0063573 A1 3/2008 Ammann et al.
2008/0154670 A1 6/2008 McAlhaney
2008/0230603 A1 9/2008 Stawar et al.
2009/0026732 A1 1/2009 Lindner et al.
2009/0046071 A1 2/2009 Griffin
2009/0188048 A1 7/2009 Shlomo
2010/0117496 A1 5/2010 Clarke et al.
2010/0139002 A1 6/2010 Walker ..... A47G 9/10 5/636
2011/0132854 A1 6/2011 Berdahl et al.
2011/0187244 A1 8/2011 Schachte
2011/0267782 A1 11/2011 Petrick et al.
2011/0291372 A1 12/2011 Stryker et al.
2011/0302713 A1 12/2011 Martenson
2011/0309591 A1 12/2011 Petrick et al.
2012/0087074 A1 4/2012 Chen
2012/0180214 A1 * 7/2012 Borgione ..... A47C 31/105 5/485
2013/0027497 A1 1/2013 Terrill et al.
2013/0200584 A1 8/2013 Guasta et al.
2014/0049014 A1 2/2014 Schumacher et al.
2014/0070504 A1 3/2014 Martin et al.
2015/0076779 A1 3/2015 Lindblom et al.

(56) References Cited

U.S. PATENT DOCUMENTS

| | | | |
|---|---|---|---|
| 2015/0282611 | A1 | 10/2015 | Herring et al. |
| 2015/0320624 | A1 | 11/2015 | Woodman et al. |
| 2016/0297458 | A1 | 10/2016 | Churchvara et al. |

* cited by examiner

PILLOW NAPKIN DISPENSING SYSTEM AND METHOD

CROSS-REFERENCE TO RELATED APPLICATIONS

This application is a continuation application of U.S. patent application Ser. No. 15/589,282, filed May 8, 2017, which is a continuation of U.S. patent application Ser. No. 15/466,259, filed Mar. 22, 2017, which is a continuation of U.S. patent application Ser. No. 14/864,074, filed Sep. 24, 2015, now U.S. Pat. No. 9,635,961, which is a continuation application of U.S. patent application Ser. No. 14/061,950, filed Oct. 24, 2013, now U.S. Pat. No. 9,386,868. These applications are hereby incorporated herein by reference, in their entireties.

TECHNICAL FIELD

The present disclosure generally relates to systems that include a carton configured to dispense one or more pillow napkins that act as a cleanliness barrier between a user and a pillow to prevent dirt and/or oil from being left on the pillow, wherein the carton is adapted for use in a location, such as, for example, a retail store that displays and/or sells pillows each having different configurations. Methods of use are provided.

BACKGROUND

Sleep is critical for people to feel and perform their best, in every aspect of their lives. Sleep is an essential path to better health and reaching personal goals. Indeed, sleep affects everything from the ability to commit new information to memory to weight gain. It is therefore essential for people to use bedding that suit both their personal sleep preference and body type in order to achieve comfortable, restful sleep.

Pillows are an important aspect in achieving proper sleep. It is therefore beneficial to select a pillow based on a user's body type, sleep preference (side sleeper, back sleeper or stomach sleeper) or the type of mattress the user uses or intends to use, etc., so that the user achieves maximum spinal alignment and/or comfort. However, pillows are rarely tested prior to purchase at least in part because of dirt and/or oil left behind on the pillow, which often renders the pillow unsellable. Moreover, when pillow napkins are used to prevent dirt and/or oil from soiling the pillow during testing, such pillow napkins bear no relationship to the number of pillows sold by a given retailer. This disclosure describes an improvement over these prior art technologies.

SUMMARY

In one embodiment, in accordance with the principles of the present disclosure, a dispenser for pillow napkins is provided. The dispenser includes a carton comprising a bottom panel, opposite left and right panels extending vertically from the bottom panel, opposite front and back panels positioned between the left and right panels and extending vertically from the bottom panel, and a top panel extending parallel to the bottom panel and engaging top surfaces of the left, right, front and back panels. Inner surfaces of the bottom, left, right, front, back and top panels define a cavity. A left support is positioned within the cavity such that the left support engages the inner surfaces of the top, bottom and left panels. A right support is positioned within the cavity such that the right support engages the inner surfaces of the top, bottom and right panels and is spaced apart from the left support. A plurality of pillow napkins is wound about a spool. The spool is positioned in the cavity such that the spool rotatably engages the left and right supports and the pillow napkins are spaced apart from the top and bottom panels.

In one embodiment, in accordance with the principles of the present disclosure, a system for marketing bedding is provided. The system includes a dispenser comprising: a carton comprising a bottom panel, opposite left and right panels extending vertically from the bottom panel, opposite front and back panels positioned between the left and right panels and extending vertically from the bottom panel, and a top panel extending parallel to the bottom panel and engaging top surfaces of the left, right, front and back panels, wherein inner surfaces of the bottom, left, right, front, back and top panels define a cavity, a left support positioned within the cavity such that the left support engages the inner surfaces of the top, bottom and left panels, a right support positioned within the cavity such that the right support engages the inner surfaces of the top, bottom and right panels and is spaced apart from the left support, and a spool comprising a plurality of pillow napkins wound about the spool, the spool being positioned in the cavity such that the spool rotatably engages the left and right supports and the pillow napkins are spaced apart from the top and bottom panels. The system further includes a plurality of pillows, each of the pillows having a different configuration. The pillow napkins are each configured to cover at least a portion of each of the pillows when a respective pillow is being tested by a consumer. In some embodiments, the pillow napkins are configured to cover a majority of the surface of each of the pillows when a respective pillow is being tested by a consumer to ensure the pillow can be fitted to the customer's body frame, e.g. tucked into the shoulder space beneath the jawline while keeping the pillow covered.

In one embodiment, in accordance with the principles of the present disclosure, a method of marketing bedding is provided. The method includes: providing a dispenser for pillow napkins comprising: a carton comprising a bottom panel, opposite left and right panels extending vertically from the bottom panel, opposite front and back panels positioned between the left and right panels and extending vertically from the bottom panel, and a top panel extending parallel to the bottom panel and engaging top surfaces of the left, right, front and back panels, wherein inner surfaces of the bottom, left, right, front, back and top panels define a cavity, a left support positioned within the cavity such that the left support engages the inner surfaces of the top, bottom and left panels, a right support positioned within the cavity such that the right support engages the inner surfaces of the top, bottom and right panels, and a spool comprising a plurality of pillow napkins wound about the spool, the spool being positioned in the cavity such that the spool rotatably engages the left and right supports and the pillow napkins are spaced apart from the top and bottom panels; providing a plurality of pillows; dispensing one of the pillow napkins from the carton; positioning the dispensed pillow napkin on one the pillows; and positioning a head of a consumer on the dispensed pillow napkin to assess the suitability of the pillow underneath the dispensed pillow napkin. The number of pillow napkins used versus the number of pillows sold is compared to determine if the required sales approach of using a pillow napkin with each pillow/mattress sale is being followed. In some embodiments, the number of pillow napkins used versus the number of pillows sold is compared to determine if the required sales approach of using a pillow napkin with each pillow/mattress sale is being followed.

In one embodiment, a pillow to pillow napkin ratio is determined. The determined ratio is then compared to a predetermined acceptable value and if the value is below an acceptable value for the retail store then the retail store is contacted and possibly additional training is provided for sales personnel so that the proper sales techniques are followed. In one embodiment, a customer to pillow napkin ratio is determined. The determined ratio is then compared to a predetermined acceptable value and if the value is below an acceptable value for the retail store then the retail store is contacted and possibly additional training is provided for sales personnel so that the proper sales techniques are followed.

BRIEF DESCRIPTION OF THE DRAWINGS

The present disclosure will become more readily apparent from the specific description accompanied by the following drawings, in which.

Like reference numerals indicate similar parts throughout the figures.

DETAILED DESCRIPTION

Figure 1:
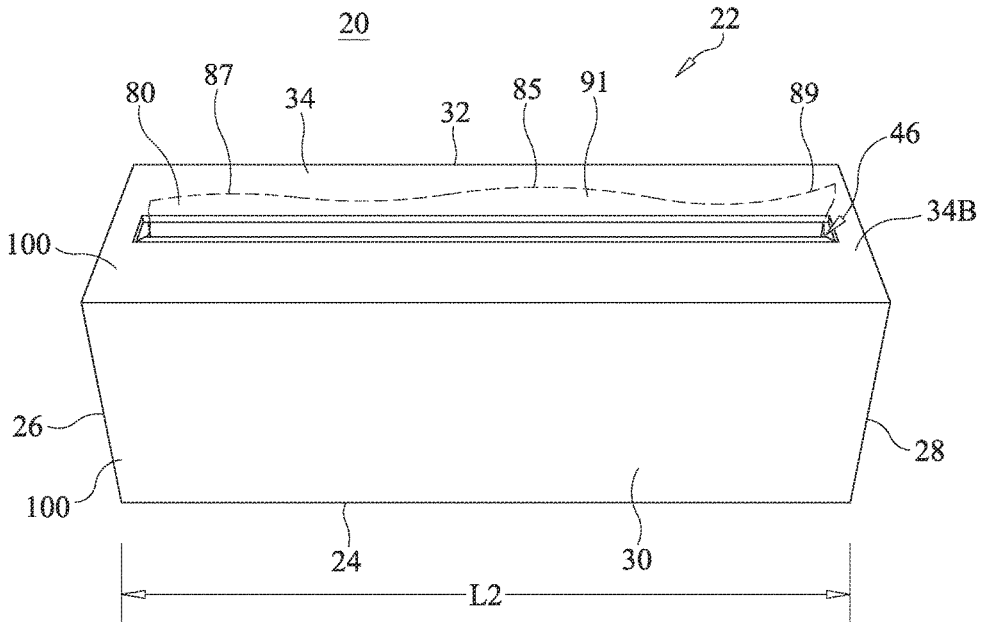
FIG. 1 is a perspective view of one embodiment of components of a pillow napkin dispensing system in accordance with the principles of the present disclosure.

The exemplary embodiments of a pillow napkin dispensing system and related methods of use are discussed in terms of systems that include a carton configured to dispense one or more pillow napkins that act as a cleanliness barrier between a user and a pillow to prevent dirt and/or oil from being left on the pillow. The present disclosure may be understood more readily by reference to the following detailed description of the disclosure taken in connection with the accompanying drawing figures, which form a part of this disclosure. It is to be understood that this disclosure is not limited to the specific devices, methods, conditions or parameters described and/or shown herein, and that the terminology used herein is for the purpose of describing particular embodiments by way of example only and is not intended to be limiting of the claimed disclosure.

Also, as used in the specification and including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment. It is also understood that all spatial references, such as, for example, horizontal, vertical, top, upper, lower, bottom, left and right, are for illustrative purposes only and can be varied within the scope of the disclosure. For example, the references "upper" and "lower" are relative and used only in the context to the other, and are not necessarily "superior" and "inferior".

The following discussion includes a description of a pillow napkin dispensing system, related components and methods of employing the pillow napkin dispensing system in accordance with the principles of the present disclosure. Alternate embodiments are also disclosed. Reference will now be made in detail to the exemplary embodiments of the present disclosure, which are illustrated in the accompanying figures. Turning to FIGS. 1-11, there are illustrated components of a pillow napkin dispensing system 20.

The components of system 20 can be fabricated from materials including metals, polymers and/or composites, depending on the particular application. For example, the components of system 20, individually or collectively, can be fabricated from materials such as fabrics or textiles, paper or cardboard, cellulosic-based materials, biodegradable materials, plastics and other polymers, metals, semi-rigid and rigid materials. Various components of system 20 may have material composites, including the above materials, to achieve various desired characteristics such as strength, rigidity, elasticity, performance and durability. The components of system 20, individually or collectively, may also be fabricated from a heterogeneous material such as a combination of two or more of the above-described materials. The components of system 20 can be extruded, molded, injection molded, cast, pressed and/or machined. The components of system 20 may be monolithically formed, integrally connected or include fastening elements and/or instruments, as described herein.

System 20 includes a rectangular carton 22 comprising a bottom panel 24, a left panel 26 and a right panel 28 opposite panel 26. Panels 26, 28 extend vertically from panel 24. Carton 22 has a length l defined by the distance between panels 26, 28. Carton 22 further includes a front panel 30 and a back panel 32 opposite panel 30. Panels 30, 32 are each positioned between panels 26, 28. Panels 30, 32 extend vertically from panel 24. Carton 22 has a width w defined by the distance between panels 30, 32. Width w is less than length l. A top panel 34 extends parallel to panel 24 and engages top surfaces of panels 26, 28, 30, 32. Panel 24 includes an inner surface 24*a*; panel 26 includes an inner surface 26*a*; panel 28 includes an inner surface 28*a*; panel 30 includes an inner surface 30*a*; panel 32 includes an inner surface 32*a*; panel 34 includes an inner surface 34*a*. Surfaces 24*a*, 26*a*, 28*a*, 30*a*, 32*a*, 34*a* define a rectangular cavity 36. In some embodiments, width w is equal to or greater than length l. In some embodiments, carton 22 and/or cavity 36 are variously shaped, such as, for example, cylindrical, triangular, square, hexagonal, polygonal, irregular, uniform, non-uniform, offset, staggered, undulating, arcuate, variable and/or tapered. In some embodiments, panel 34 may be disposed at alternate orientations relative to panel 24, such as, for example, transverse, perpendicular and/or other angular orientations such as acute or obtuse, co-axial and/or may be offset or staggered.

Figure 3:
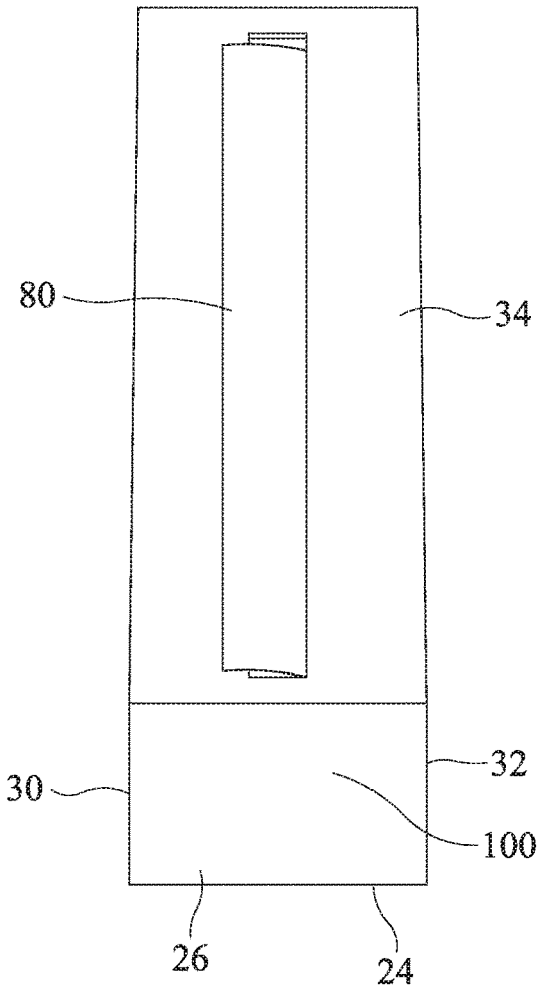
FIG. 3 is an end view of components of the system shown in FIG. 1.
Figure 4:
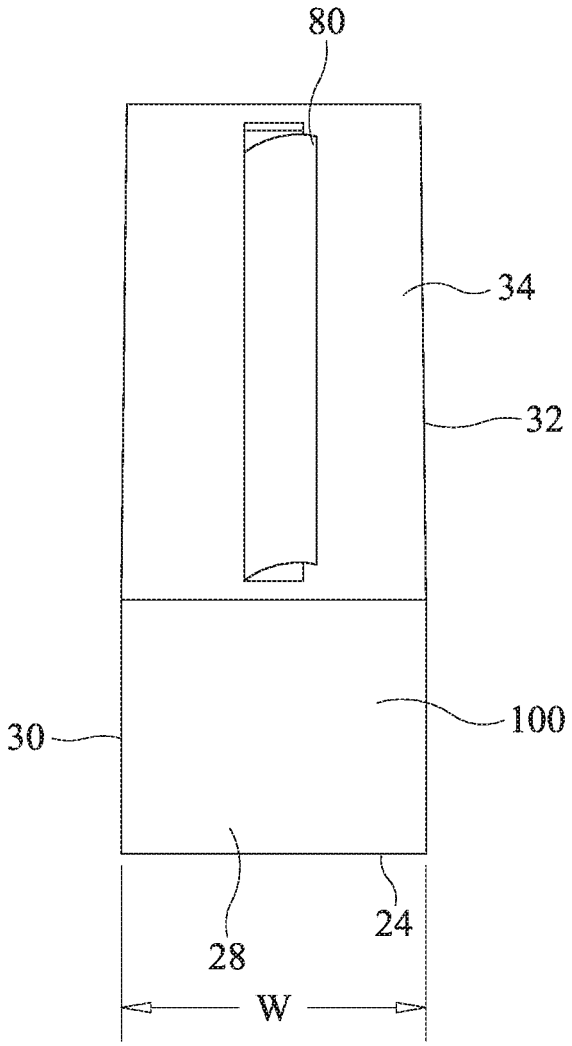
FIG. 4 is an end view of components of the system shown in FIG. 1.
Figure 6:
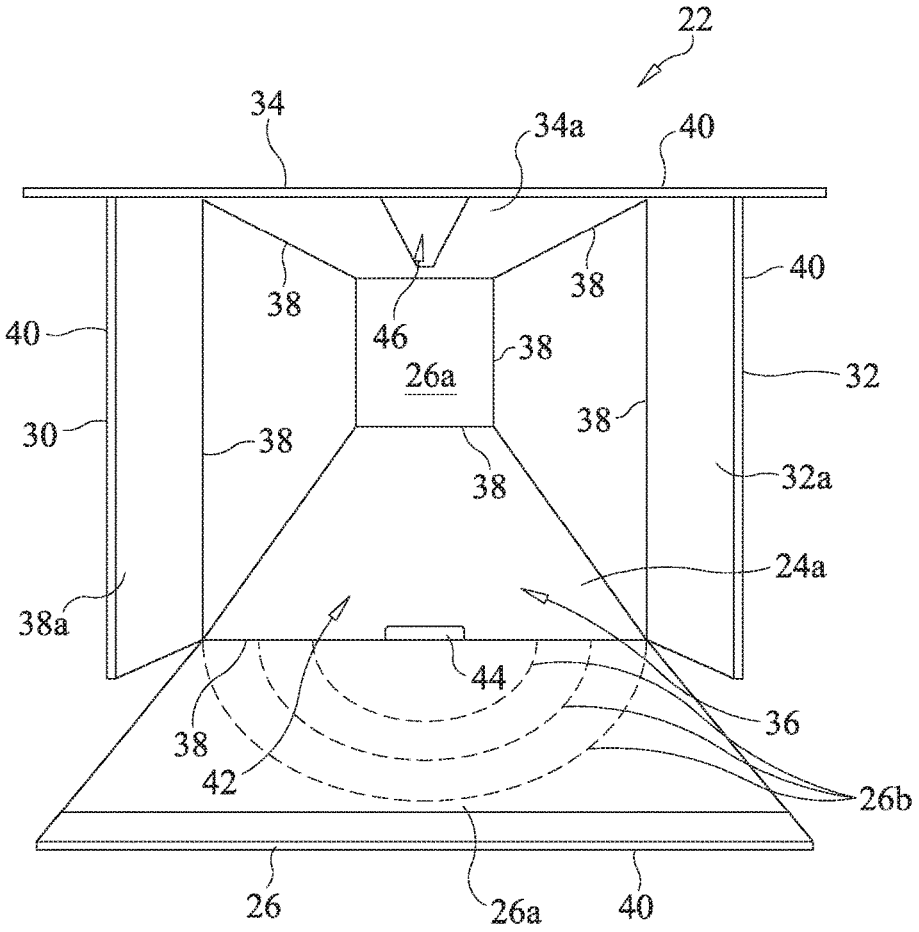
FIG. 6 is an end view of a component of the system shown in FIG. 1
Figure 7:
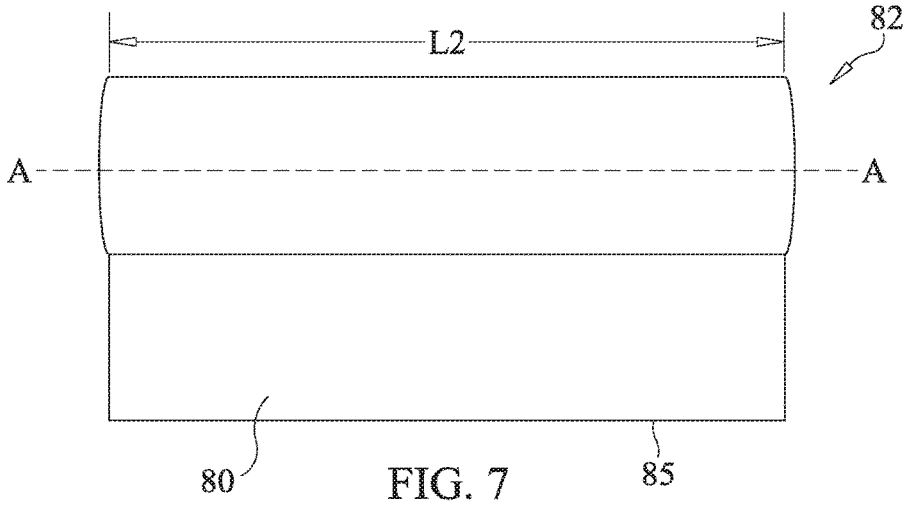
FIG. 7 is a perspective view of components of the system shown in FIG. 1.
Figure 8:
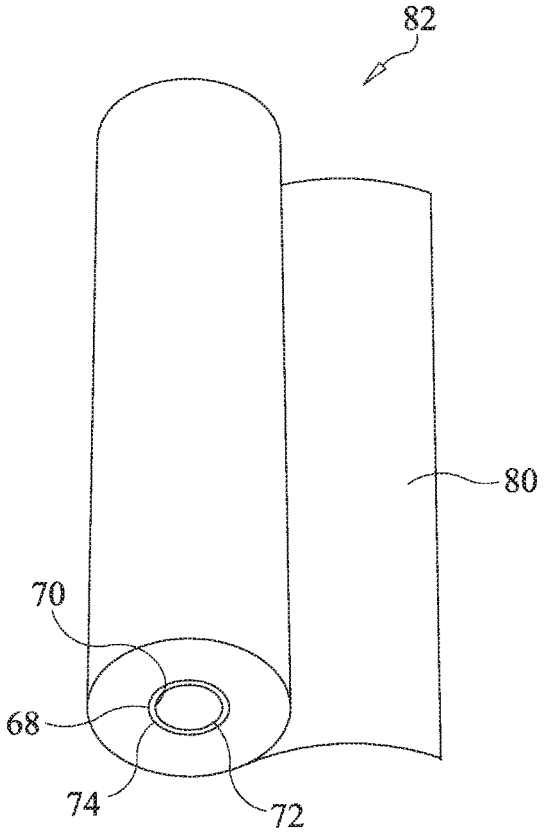
FIG. 8 is an end view of components of the system shown in FIG. 1.
Figure 9:
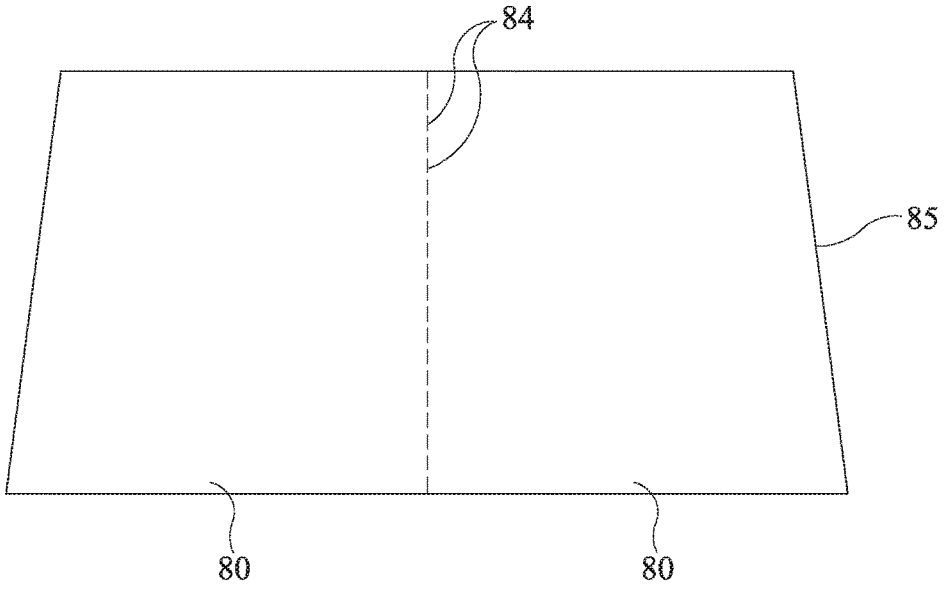
FIG. 9 is a perspective view of a component of the system shown in FIG. 1.
Figure 10:
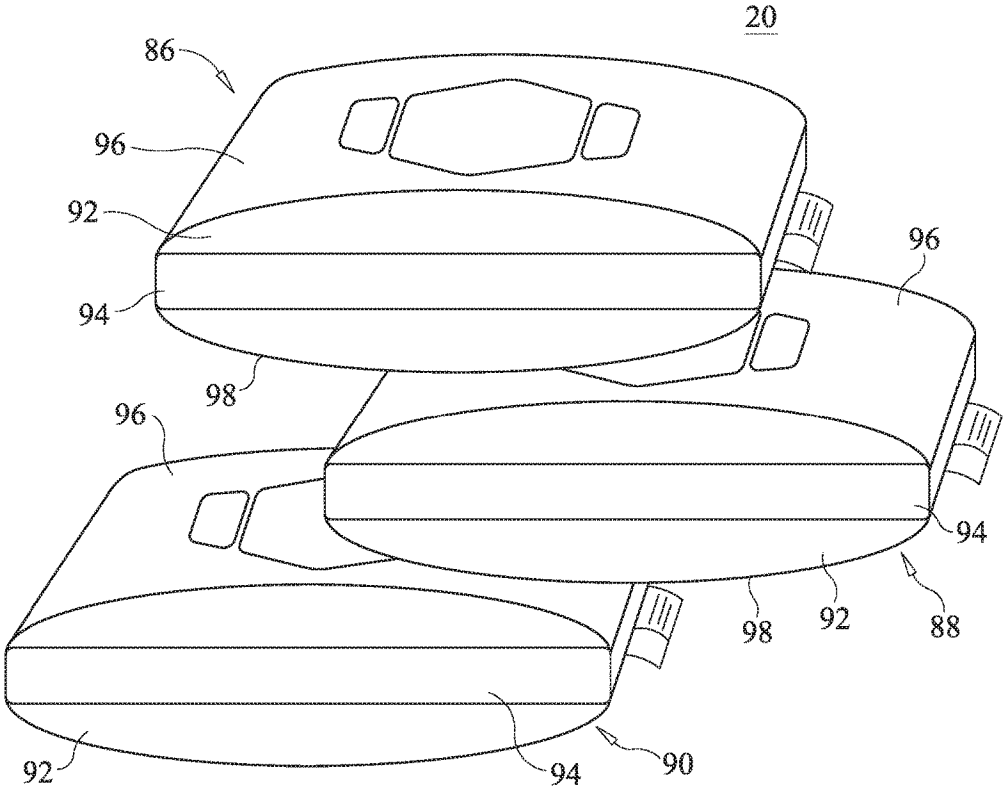
FIG. 10 is a perspective view of one embodiment of additional components of the system shown in FIG. 1, in accordance with the principles of the present disclosure.

In some embodiments, at least one of panels 24, 26, 28, 30, 32, 34 includes a fold or crease 38 that forms a bend between panel 24, 26, 28, 30, 32 or 34 and an adjacent panel such that one of panels 24, 26, 28, 30, 32, 34 is continuous with another of panels 24, 26, 28, 30, 32, 34. This configuration allows carton 22 to be formed from a single sheet of material, such as, for example, cardboard. In some embodiments, creases 38 form flaps 40 that are movable between a first position in which flaps 40 are spaced apart from one another so as to define an opening 42 that is in communication with cavity 36, as shown in FIG. 6, and a second position in which flaps 40 overlap one another, as shown in FIG. 3. In some embodiments, carton 22 includes an opening 42 adjacent panel 26 and an opening 42 adjacent panel 28 when flaps 40 are in the first position. In some embodiments, carton 22 includes an opening 42 adjacent panel 26 or an opening 42 adjacent panel 28 when flaps 40 are in the first position. In some embodiments, at least one of flaps 40 includes a tab 44 configured for disposal in a recess in another one of flaps 40 to fix flaps 40 relative to one another. That is, disposing tab 44 in a recess in one of flaps 40 maintains flaps in the first position shown in FIG. 3.

Figure 2:
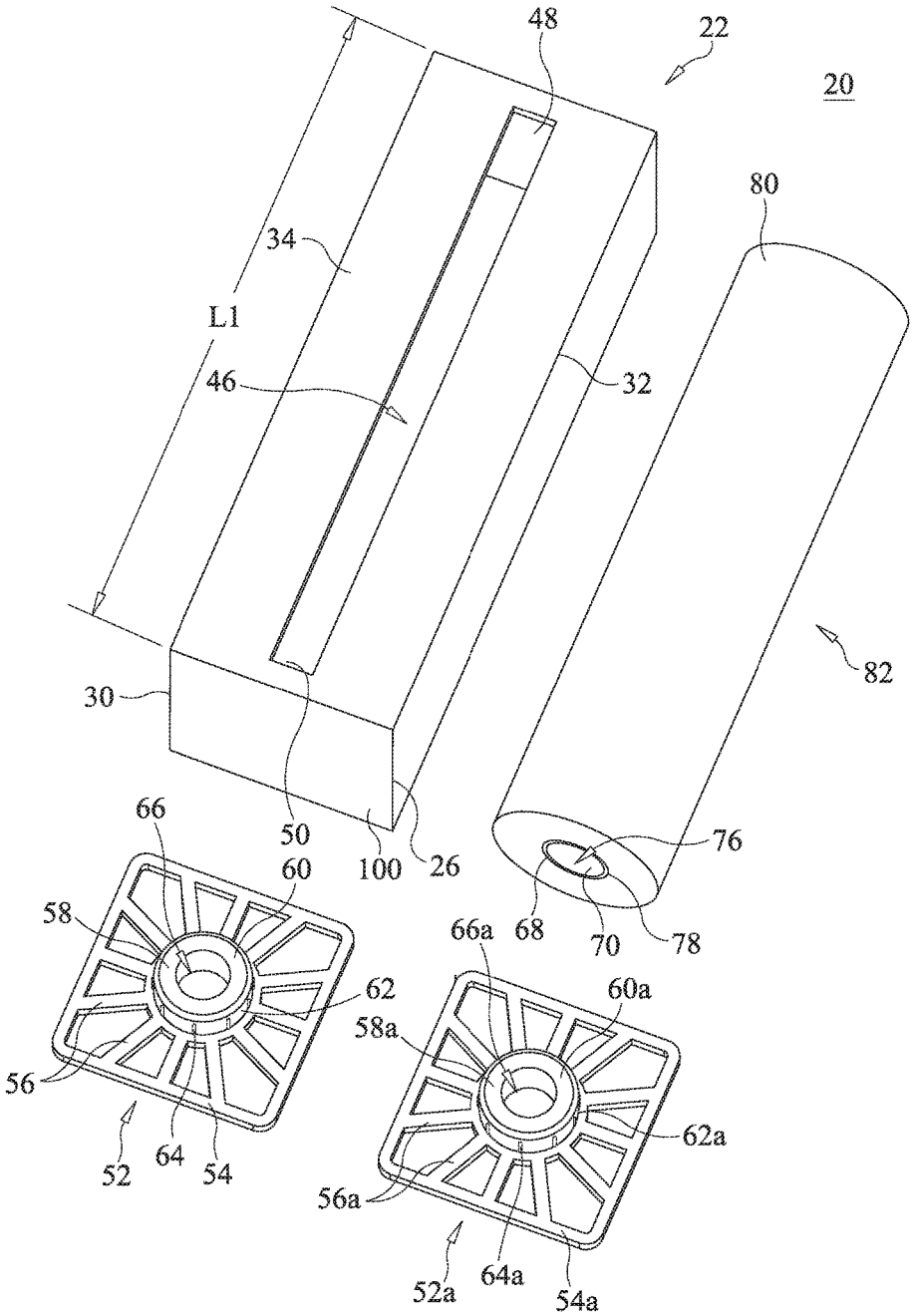
FIG. 2 is a perspective view of components of the system shown in FIG. 1, with parts separated.
Figure 5:
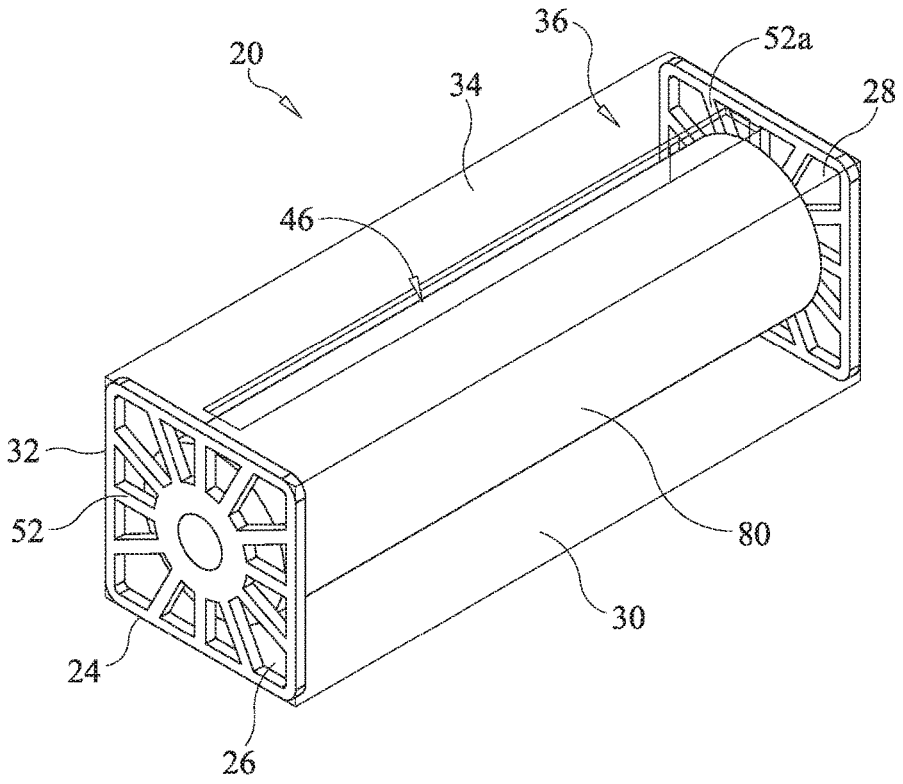
FIG. 5 is a perspective view of components of the system shown in FIG. 1, in part phantom.

Panel 34 includes an oblong slot 46 extending through surface 34*a* and an exterior surface 34*b* of panel 34. Slot 46 is in communication with cavity 36. As shown in FIGS. 2 and 5, slot 46 is centrally positioned in panel 34. Slot 46 extends between a first end 48 and a second end 50. Slot has a length l1 defined by the distance between ends 48, 50. Length l1 is less than length l. In some embodiments, slot 46 is variously shaped, such as, for example, oval, triangular, rectangular, square, polygonal, irregular, uniform, non-uniform, offset, staggered, undulating, arcuate, variable and/or tapered. In some embodiments, slot 46 is positioned off-center relative to panel 34 such that slot is closer to panel 26 than panel 28 and/or is closer to panel 30 than panel 32. In some embodiments, carton 22 includes a slot having a configuration similar to that of slot 46 extending through at least one of panels 24, 30, 32.

System 20 includes a left support 52 removably positioned within cavity 36 such that an outer surface 54 of support 52 engages surfaces 24*a*, 26*a*, 30*a*, 32*a*, 34*a*. Support 52 has a square cross sectional configuration that substantially matches the configuration of panel 26. Support 52 includes a plurality of spokes 56 extending radially from a central hub 58 configured to reduce the weight of support 52 and/or reduce manufacturing costs thereof. Hub 58 projects outwardly from spokes 56 such that an end surface 60 of hub 58 is proud relative to spokes 56. Hub 58 has a uniform cylindrical cross sectional configuration from spokes 56 to surface 60. In some embodiments, hub 58 is rounded between an outer surface 62 of hub 58 and surface 60. In some embodiments, surface 62 includes one or more ridges 64 projecting from surface 62. Ridges 64 extend parallel to one another and are spaced apart from one another. Hub 58 includes a central opening 66 configured to reduce the weight of support 52 and/or reduce manufacturing costs thereof. In some embodiments, support 52 is free of spokes 56 and opening 66 such that support 52 has a solid configuration. In some embodiments, support 52 and/or hub 58 may have various cross section configurations, such as, for example, circular, cylindrical, oval, triangular, rectangular, square, polygonal, irregular, uniform, non-uniform, variable, tubular and/or tapered. In some embodiments, support 52 comprises a plastic material.

System 20 includes a right support 52*a* removably positioned within cavity 36 such that an outer surface 54 of support 52 engages surfaces 24*a*, 28*a*, 30*a*, 32*a*, 34*a*. Support 52*a* is similar to support 52 and has a square cross sectional configuration that substantially matches the configuration of panel 28. Support 52*a* includes a plurality of spokes 56*a* extending radially from a central hub 58*a*. Hub 58*a* projects outwardly from spokes 56*a* such that an end surface 60*a* of hub 58*a* is proud relative to spokes 56*a*. Hub 58*a* has a uniform cylindrical cross sectional configuration from spokes 56 to surface 60. In some embodiments, hub 58*a* is rounded between an outer surface 62*a* of hub 58*a* and surface 60*a*. In some embodiments, surface 62*a* includes one or more ridges 64*a* projecting from surface 62*a*. Ridges 64*a* extend parallel to one another and are spaced apart from one another. Hub 58*a* includes a central opening 66*a*. In some embodiments, support 52*a* is free of spokes 56*a* and opening 66*a* such that support 52*a* has a solid configuration. In some embodiments, support 52*a* and/or hub 58*a* may have various cross section configurations, such as, for example, circular, cylindrical, oval, triangular, rectangular, square, polygonal, irregular, uniform, non-uniform, variable and/or tapered. In some embodiments, support 52*a* comprises a plastic material. Supports 52, 52*a* are positioned in cavity 36 such that hub 58 faces away from panel 26 and hub 58*a* faces away from panel 28. That is, hubs 58, 58*a* face one another and are spaced apart.

System 20 includes a cylindrical spool 68 comprising an inner surface 70 defining a first circular opening 72 in a first end 74 of spool 68 and a second circular opening 76 in a second end 78 of spool 68. Spool 68 extends along a longitudinal axis A between end 74 and end 78. Opening 72 has a width or diameter that is slightly greater than that of hub 58 such that hub 58 may be positioned in opening 72 such that surface 62 engages surface 70 in a manner that forms a friction fit to fix support 52 with spool 68. Opening 74 likewise has a width or diameter that is slightly greater than that of hub 58*a* such that hub 58*a* may be positioned in opening 74 such that surface 62*a* engages surface 70 in a manner that forms a friction fit to fix support 52*a* with spool 68. In embodiments where supports 52, 52*a* include ridges 64, 64*a* on hubs 58, 58*a*, ridges 64, 64*a* engage surface 70 to prevent rotation of spool 68 relative to supports 52, 52*a*. In some embodiments, spool 68 includes a hollow passageway extending between openings 72, 74. Spool 68 has a length l2 defined by the distance between end 74 and end 78. Length l2 is less than length l and greater than length l1 such that spool 68 may be disposed in cavity 36. In some embodiments, spool 68 is solid between openings 72, 74. In some embodiments, spool 68, opening 72 and/or opening 74 may have various cross section configurations, such as, for example, circular, cylindrical, oval, triangular, rectangular, square, polygonal, irregular, uniform, non-uniform, variable and/or tapered. In some embodiments, hubs 58, 58*a* are conical to minimize friction with surface 70 to facilitate rotation of spool 68 relative to supports 52, 52*a*.

A plurality of pillow napkins 80 are wound about spool 68 such that napkins 80 are in the form of a roll 82. Adjacent napkins 80 of roll 82 are joined together by lines of weakness or perforations 84 to permit a single napkin 80 to be separated from roll 82 without cutting the same with a scissor or other cutting means. In some embodiments, roll 82 includes a pre-determined number of napkins 80. For example, roll 82 may be pre-loaded on spool 68 with a certain number of napkins, such as, for example, 100, 250, 500, 1000 napkins. This allows a retailer to know how many rolls 82 to order, given a known inventory of pillows. For example, if the retailer has an inventory of 1000 pillows, the retailer may choose to order more or less than 1000 napkins 80. Given that the amount of napkins 80 per roll is known, the retailer can easily determine the number of rolls to order to accommodate his or her inventory of pillows. In some embodiments, roll 82 is formed from a single unperforated sheet and carton 22 includes a cutting means, such as, for example, a serrated edge adjacent slot 46 configured to cut a selected length from the sheet.

In some embodiments, at least one of surfaces 26*a*, 28*a* comprises indicia, such as, for example, indicia 26*b*, shown in FIG. 6, that indicates the number of napkins 80 left on roll 82. That is, indicia 26*b* are calibrated to indicate the number of napkins 80 left on roll 82. Because the number of napkins 80 on a roll 82 is known, the number of napkins 80 used may be determined by simply subtracting the number of napkins 80 originally included in roll 82 and the number of napkins 80 left on roll 82. As shown in FIG. 6, indicia 26*b* are arcuate lines that correlate to the circumference of roll 82 when roll 82 has a given number of napkins 80. That is, when roll 82 has X napkins left, where X is a known number, the perimeter of roll 82 will be consistent with the outermost indicia 26*b*. As napkins 80 are used, the number of napkins 80 on roll 82 will be reduced. When roll 82 has Y napkins left, where Y is a known number, the perimeter of roll 82 will be consistent with the middle indicia 26*b*. Likewise, when roll 82 has Z napkins left, where Z is a known number, the perimeter of roll 82 will be consistent with the innermost indicia 26*b*. This provides a means for a retailer to estimate how many napkins 80 are left on a given roll 82 by simply looking at one or both of panels 26, 28. This may assist the retailer in knowing how soon to reorder another roll 82 of napkins 80, for example. In some embodiments, carton 22 comprises one or a plurality of indicia 26*b*.

In some embodiments, the first napkins 80 that are wound about spool 68 include markings to indicate when roll 82 is getting low on napkins. That is, at least a portion of each of the first 5-50 napkins 80 wound about spool 68 may include a color that is different from the remaining napkins 80 wound about spool 68 so that when a retailer pulls out a napkin 80 that includes such color coding it will indicate to the retailer that there is only a small number of napkins 80 remaining on spool 68, and that it is time to reorder napkins 80. In some embodiments, the markings on a portion of the first napkins 80 that are wound about spool 68 include indicia, such as, wording. In some embodiments, the indicia may be a manufacturer name, such as, the name of the manufacturer of pillows that are sold using napkins 80 or the name of the manufacturer of napkins 80. In some embodiments, the indicia is stamped onto the first napkins 80 that are wound about spool 68.

In some embodiments, the original number of napkins 80 on roll 82 and the weight of spool 68, roll 82 and each napkin 80 are known. This allows a retailer to weigh spool 68 and roll 82 to determine the number of napkins 80 used from roll 82 by subtracting the weight of spool 68 and roll 82 after at least one napkin 80 has been dispensed from carton 22 and removed from roll 82 from the original weight of spool 68 and roll 82 and dividing by the weight of each napkin 80. In that the original number of napkins 80 on roll 82 is known, the number of napkins 80 used from roll 82 can be subtracted from the original number of napkins 80 on roll 82 to determine the number of napkins 80 remaining on roll 82.

Napkins 80 are sheets of flexible material, such as textile, paper or other cellulosic-based material, or combinations thereof. Napkins 80 sized and shaped to act as a cleanliness barrier for a person's head for resting on a pillow. In some embodiments, napkins 80 are virtually invisible (translucent) to the guest and do not create friction or static when the guest rests a portion of his or her body on napkins 80, and are essentially noiseless (do not create sound when the guests rests a portion of his or her body on napkins 80). In some embodiments, napkins 80 are made of non-woven polyester fibers. In some embodiments, napkins 80 are made of biodegradable materials, such as, for example, corn-based fiber material. In some embodiments, napkins 80 are free of any elastic material, in order to avoid napkins from gripping or otherwise becoming fixed to a person's head. In some embodiments, napkins 80 are provided with colors, scents and/or prints to enhance appearance and/or to convey a message. In some embodiments, napkins 80 are intended for single use with disposal thereof after the single use. Napkins 80 each have a maximum axial or longitudinal length l2. That is, the maximum length of a portion of each napkin 80 that extends parallel to axis A is equal to length l2. In some embodiments, napkins 80 have a maximum longitudinal length that is greater than length l2 such that napkins 80 overlap ends 74, 78. That is, in embodiments where napkins 80 each have a maximum longitudinal length that is greater than length l2, opposite ends of napkins extend beyond opposite end surfaces of spool 68. In that the overlapping portions of napkins 80 engage ends 74, 78, this configuration prevents roll 82 from disengaging spool 68.

Spool 68 is positioned in cavity 36 with hub 58 positioned in opening 72 and hub 58*a* positioned in opening 76 such that slot 46 extends parallel to axis A and roll 82 is spaced apart from panels 24, 34 in a manner that allows roll 82 to rotate relative to supports 52, 52*a* about axis A. This configuration allows one or more napkins 80 disengage roll 82 such that the disengaged napkin 80 may extend through slot 46, as shown in FIG. 1. Because napkins 80 each have a maximum length l2, which is greater than length l1 of slot 46, napkins 80 are cinched, crinkled or otherwise folded upon themselves to reduce the maximum longitudinal length of napkins 80 to fit through slot 46. In some embodiments, the added length of napkins 80 relative to slot 46 causes napkins 80 to at least somewhat conform to the shape of slot 46 as napkins 46 are moved through slot 46. That is, as a respective napkin 80 protrudes through slot 46, opposite portions 87, 89 of a leading edge 85 of the respective napkin 80 extend transverse to axis A, while a portion 91 of the respective napkin 80 positioned between portions 87, 89 extends parallel or substantially parallel to axis A. This configuration allows the respective napkin 80 to engage the surface that defines slot 46 in a manner that requires an application of force to rotate roll 82 relative to supports 52, 52*a*.

Pulling the disengaged napkin 80 will cause the disengaged napkin 80 to move further through slot 46 until the entire disengaged napkin 80 is positioned outside of cavity 36. This may also be accomplished by rotating roll 82 about axis A in a first direction, such as, for example, clockwise or counterclockwise. In order to reengage the disengaged napkin 80, roll 82 may be rotated in a second direction that is opposite the first direction, such as, for example, clockwise or counterclockwise. As roll 82 is rotated in the second direction, all or only a portion of the disengaged napkin 80 moves from outside cavity 36 to inside cavity 36.

In some embodiments, hubs 58, 58*a* are rotatable relative to spokes 56, 56*a*. In some embodiments, system 20 includes a mechanism to facilitate rotation of hubs 58, 58*a* relative to spokes 56, 56*a*. In some embodiments, the mechanism includes at least one spring having a first end that engages at least one of carton 22, support 52 and support 52*a* and a second end that engages at least one of hub 58, hub 58*a*, spool 68 and roll 82 such that puffing edge 85 of a napkin 80 protruding through slot 46 even a small amount will cause hubs 58, 58*a* to rotate relative to spokes 56, 56*a* approximately 360 such that after a respective napkin 80 is removed from roll 82, edge 85 of an adjacent napkin 80 is positioned adjacent slot 46.

Napkins 80 are used to cover a portion of a pillow, such as, for example, a portion of a pillow, such as, for example, a pillow 86, a pillow 88 or a pillow 90. At least one of pillows 86, 88, 90 have a different configuration than another of pillows 86, 88, 90. For example, it is envisioned that pillows 86, 88, 90 may differ from one another with respect to size, material, and/or shape. In some embodiments, at least one of pillows 86, 88, 90 have a filler comprising latex. In some embodiments, at least one of pillows 86, 88, 90 have a filler comprising memory foam. In some embodiments, at least one of pillows 86, 88, 90 have a filler comprising a gel. In some embodiments, at least one of pillows 86, 88, 90 have a filler comprising a down-alternative hypoallergenic material. It is envisioned that system 20 may include any number of pillow, such as, for example, pillows 86, 88, 90, and may include pillows having configurations that differ from those described herein. That is, the present disclosure is intended to include conventional pillows in addition to pillows 86, 88, 90 described herein.

In some embodiments, at least one of pillows 86, 88, 90 has includes a side panel 92 having a gusset 94 and at least one of pillows 86, 88, 90 does not. It is envisioned that the gussets may comprise a breathable fabric that is different than the material(s) that comprise the remaining portions of a respective pillow 86, 88, 90. In some embodiments, at least one of pillows 86, 88, 90 has gusseted sides positioned between front and back panels 96, 98 that are not gusseted and at least one of pillows 86, 88, 90 does not. In some embodiments, at least one of pillows 86, 88, 90 has a gusset 94 in a side panel 92 positioned between front and back panels, wherein at least one of the front and back panels 96, 98 is also gusseted and at least one of pillows 86, 88, 90 does not. In some embodiments, at least one of pillows 86, 88, 90 has a removable core and at least one of pillows 86, 88, 90 does not. In some embodiments, at least one of pillows 86, 88, 90 has a shell including a zipper along a front bottom edge and removable core disposed within the shell and at least one of pillows 86, 88, 90 does not. In some embodiments, at least one of pillows 86, 88, 90 has a self-leveling core and at least one of pillows 86, 88, 90 does not. In some embodiments, at least one of pillows 86, 88, 90 has a shock absorber core comprising visco-memory foam and gel fiber and at least one of pillows 86, 88, 90 does not. In some embodiments, at least one of pillows 86, 88, 90 has a latex core that is blended with gel-fiber clusters and at least one of pillows 86, 88, 90 does not. In some embodiments, at least one of pillows 86, 88, 90 has a resilient core and at least one of pillows 86, 88, 90 does not. In some embodiments, at least one of pillows 86, 88, 90 has metallic corded seams and at least one of pillows 86, 88, 90 does not. In some embodiments, at least one of pillows 86, 88, 90 has metallic corded seams and gusseted sides and at least one of pillows 86, 88, 90 does not. In some embodiments, at least one of pillows 86, 88, 90 comprises a moisture-wicking, stain-resistant fabric, such as, for example, Dri-Tec® sold by Bedgear™ of Farmingdale, N.Y. (see bedgear.com (version present on the filing date of the instant application and any versions prior thereto), the contents of which are incorporated herein by reference), and at least one of pillows 86, 88, 90 does not. In some embodiments, at least one of pillows 86, 88, 90 comprises a solid latex and solid memory foam blend and at least one of pillows 86, 88, 90 does not. In some embodiments, at least one of pillows 86, 88, 90 has mesh sidewalls and at least one of pillows 86, 88, 90 does not. In some embodiments, at least one of pillows 86, 88, 90 has mesh sidewalls and a filter fabric behind the mesh sidewalls and at least one of pillows 86, 88, 90 does not. In some embodiments, at least one of pillows 86, 88, 90 has a liquid layer and at least one of pillows 86, 88, 90 does not.

In some embodiments, at least one of pillows 86, 88, 90 is formed with greater thickness and rigidity, so as to be more lofty and structured, than another of pillows 86, 88, 90, to provide higher support for a person's head during sleep on their side such that sufficient head support is provided against neck compression (e.g., sufficient fill is provided against the shoulder line to avoid neck compression). In some embodiments, at least one of pillows 86, 88, 90 is formed softer than another one of pillows 86, 88, 90 to accommodate a person's head and face, e.g. by conforming to a person's facial features, when sleeping on their stomach as opposed to their back. In some embodiments, at least one of pillows 86, 88, 90 is formed more flat and firm than another of pillows to minimize stress on a person's neck and back while sleeping on their back.

People tend to sleep on their stomach, back or side. When people sleep on their stomach, their shins make contact with the mattress and their body weight is evenly distributed. Adequate support under the person's hips keeps his or her body aligned. A pillow for people that sleep on their stomach must therefore support the person's head and neck for proper spinal alignment. When people sleep on their back, the backs of their legs make contact with a comfort layer of the mattress such that that the person's body weight is evenly distributed. Adequate support under the person's hips keeps his or her body aligned. A pillow for people that sleep on their back must therefore support the person's head and neck for proper spinal alignment. When people sleep on their side, their hips are aligned with the rest of his or her body and his or her shoulders sink into a comfort layer of the mattress. A pillow for people that sleep on their side must therefore support the person's head and neck for proper spinal alignment.

In some embodiments, at least one of pillows 86, 88, 90 is configured for people that sleep on their stomach, at least one of pillows 86, 88, 90 is configured for people that sleep on their back and at least one of pillows 86, 88, 90 is configured for people that sleep on their side. It is envisioned that at least one of the pillows 86, 88, 90 configured for people that sleep on their stomach differs with respect to size, shape, or material relative to another of the pillows 86, 88, 90 configured for people that sleep on their stomach; at least one of the pillows 86, 88, 90 configured for people that sleep on their back differs with respect to size, shape, or material relative to another of the pillows 86, 88, 90 configured for people that sleep on their back; and at least one of the pillows 86, 88, 90 configured for people that sleep on their side differs with respect to size, shape, or material relative to another one of pillows 86, 88, 90 configured for people that sleep on their side.

In some embodiments, system 20 includes at least one pillow with a mesh gusset, as shown in U.S. Pat. No. D672,183, which issued as a United States Design Patent on Dec. 11, 2012, the contents of which are incorporated herein by reference. In some embodiments, system 20 includes at least one pillow with a mesh gusset, as shown in U.S. Pat. No. D672,184, which issued as a United States Design Patent on Dec. 11, 2012, the contents of which are incorporated herein by reference. In some embodiments, system 20 includes at least one pillow with a mesh gusset, as shown in U.S. Pat. No. D672,186, which issued as a United States Design Patent on Dec. 11, 2012, the contents of which are incorporated herein by reference.

In some embodiments, napkins 80 are planar sheets each configured to cover only a portion of a pillow, such as, for example, pillows 86, 88, 90. That is, napkins 80 are each configured to cover panel 96 without covering panel 98. In embodiments that include gussets 94, napkins 80 are configured to cover panel 96 without covering gusset 94 or panel 98. In some embodiments, napkins 80 include a single layer of material that is provided in a flat sheet, wherein edges of the sheet are spaced apart from other portions of the sheet. That is, each napkin 80 is not folded upon itself in a manner that would create pockets or define a cavity.

In some embodiments, carton 22 includes a counter, such as, for example, counter 75 configured to count the number of napkins dispensed from spool 68 and/or the number of napkins 80 remaining on spool 68. In some embodiments, counter 75 is fixed to an outer surface of carton 22. In some embodiments, counter 75 removably engages the outer surface of carton 22. It is envisioned that counter 75 may be placed anywhere on the outer surface of carton 22. In some embodiments, counter 75 is positioned within cavity 36. In some embodiments, counter 75 comprises a display that provides information, such as, for example, one or more numbers that correlate to the number of napkins 80 dispensed from spool 68 and/or the number of napkins 80 remaining on spool 68.

In some embodiments, the number of times spool 68 rotates a certain amount about an axis defined by spool 68 correlates to the number of napkins 80 dispensed from spool 68. For example, system 20 may be configured such that rotating spool 68 360 degrees about the axis defined by spool 68 dispenses one napkin 80 from carton 22, rotating spool 68 1800 degrees about the axis defined by spool 68 dispenses four napkins 80, rotating spool 68 3600 degrees about the axis defined by spool 68 dispenses seven napkins 80 from carton 22, etc. In some embodiments, counter 75 is configured to record each time spool 68 rotates a certain amount about the axis defined by spool 68, such as, for example, between about 360 degrees and about 1440 degrees. In one embodiment, counter 75 is configured to record each time spool 68 rotates 360 degrees about the axis defined by spool 68. Because the number of times spool 68 rotates 360 degrees about the axis defined by spool 68 correlates to the number of napkins 80 dispensed from spool 68, the number of napkins 80 dispensed from spool 68 is determined by counter 75. In some embodiments, the display on counter 75 displays the amount spool 68 has been rotated about the axis defined by spool 68. In some embodiments, counter 75 makes an audible clicking sound each time spool 68 rotates a certain amount about the axis defined by spool 68. In some embodiments, counter 75 can count the number of clicks. Because the number of times spool 68 rotates 360 degrees about the axis defined by spool 68 correlates to the number of times counter 75 clicks, and the number of times spool 68 rotates 360 degrees about the axis defined by spool 68 correlates to the number of napkins 80 dispensed from spool 68, the number of napkins 80 dispensed from spool 68 is determined by counter 75.

In some embodiments, napkins 80 are provided in the form of a sheet that includes a plurality of napkins 80 that are separated from one another by perforations 84, counter 75 is configured to measure the length of the sheet that is moved through slot 46 and the length of each napkin 80 is known or is determined by a measuring instrument, such as, for example, a ruler or tape measure. As such, the length of the sheet that is moved through slot 46 recorded by counter 75 is divided by the length of each napkin 80 to determine the number of napkins 80 dispensed from spool 68 using counter 75.

In some embodiments, napkins 80 are provided in the form of a sheet that includes a plurality of napkins 80 that are wound about spool 68 such that the sheet forms a plurality of rings when viewed along an axis defined by spool 68, the number of rings correlates to the number of napkins 80 remaining on spool 68 and counter 75 is configured to measure the number of rings in cavity 36. For example, two rings may indicate that there is one napkin 80 left on spool 68, six rings may indicate that there are four napkins 80 left on spool 68, ten rings may indicate that there are seven napkins 80 left on spool 68.

In some embodiments, napkins 80 are provided in the form of a sheet that includes a plurality of napkins 80 that are separated from one another by a set of perforations 84 and counter 75 is configured to measure the number of sets of perforations moved through slot 46. As such, the number of sets of perforations 84 moved through slot 46 directly correlates to the number of napkins 80 dispensed from spool 68. In some embodiments, the number of perforations 84 that make up each of the sets of perforations 84 is known and counter 75 is configured to count each perforation 84. As such, the number of perforations 84 moved through slot 46 directly correlates to the number of napkins 80 dispensed from spool 68.

In some embodiments, counter 75 includes a scale and the weight of spool 68 and each of napkins 80 is known or is determined using a scale, for example. Counter 75 is positioned within cavity 36 in a manner that allows counter 75 to weigh the combined weight of spool 68 and napkins 80 wound about spool 68. The initial weight of spool 68 with napkins 80 wound about spool 68 (the weight of spool 68 and napkins 80 before any napkins 80 are dispensed from spool 68) is known or may be determined by weighing the same with a scale and/or counter 75. Because the combined weight of spool 68 and napkins 80 wound about spool 68 will decrease with each napkin 80 that is dispensed from carton 22, the number of napkins 80 dispensed from spool 68 may be determined by subtracting the current combined weight of spool 68 and napkins 80 wound about spool 68 from the initial combined weight of spool 68 and napkins 80 wound about spool 68 and dividing by the weight of each napkin.

In operation and use, hub 58 is inserted into opening 74 such that surface 62 engages surface 70 in a manner such that ridges 64 prevents rotation of spool 68 relative to support 52. Hub 58*a* is inserted into opening 76 such that surface 62*a* engages surface 70 in a manner such that ridges 64*a* prevents rotation of spool 68 relative to support 52*a*. Supports 52, 52*a* and spool 68 are inserted into cavity 36 through one of openings 42. Supports 52, 52*a* and spool 68 are translated axially within cavity 36 until surface 62 engages surface 24*a*, 26*a*, 30*a*, 32*a*, 34*a*. Flaps 40 adjacent panel 26 are moved from the first position, shown in FIG. 6, to the second position, shown in FIG. 3. In some embodiments, supports 52, 52*a* and spool 68 are inserted into cavity 36 through the other of openings 42. In such embodiments, supports 52, 52*a* and spool 68 are translated axially within cavity 36 until surface 62*a* engages surface 24*a*, 28*a*, 30*a*, 32*a*, 34*a*. Flaps 40 adjacent panel 28 are moved from the first position, shown in FIG. 6, to the second position, shown in FIG. 3. A user then grabs a napkin 80 on roll 82 adjacent edge 85 in a manner that allows the user to pull the napkin 80 such that at least edge 85 of the napkin 82 extends through slot 46, as shown in FIG. 1.

In some embodiments, flaps 40 adjacent panel 28 are moved from the second position, shown in FIG. 3, to the first position, shown in FIG. 6. Support 52 is inserted through opening 42 and is moved into cavity 36. Support 52 is translated axially within cavity 36 until surface 62 engages surface 24*a*, 26*a*, 30*a*, 32*a*, 34*a*. Spool 68 is inserted through opening 42 into cavity 36. Spool 68 is translated axially within cavity 36 until opening 72 is positioned adjacent hub 58. Opening 72 is aligned with hub 58 such that opening 72 and hub 58 are coaxial. Spool 68 is translated within cavity 68 such that hub 58 is positioned within opening 72 in a manner such that ridges 64 prevent rotation of spool 68 relative to support 52. Support 52*a* is inserted through opening 42 such that hub 58*a* is aligned with opening 76. Support 52*a* is translated axially such that hub 58*a* is positioned within opening 76 in a manner such that ridges 64*a* prevent rotation of spool 68 relative to support 52*a*. Flaps 40 adjacent panel 28 are moved from the first position, shown in FIG. 6, to the second position, shown in FIG. 3. A user then grabs a napkin 80 on roll 82 adjacent edge 85 in a manner that allows the user to pull the napkin 80 such that at least edge 85 of the napkin 82 extends through slot 46, as shown in FIG. 1.

In some embodiments, flaps 40 adjacent panel 26 are moved from the second position, shown in FIG. 3, to the first position, shown in FIG. 6. Support 52 is inserted through opening 42 and is moved into cavity 36. Support 52*a* is translated axially within cavity 36 until surface 62*a* engages surface 24*a*, 28*a*, 30*a*, 32*a*, 34*a*. Spool 68 is inserted through opening 42 into cavity 36. Spool 68 is translated axially within cavity 36 until opening 76 is positioned adjacent hub 58*a*. Opening 76 is aligned with hub 58*a* such that opening 76 and hub 58*a* are coaxial. Spool 68 is translated within cavity 68 such that hub 58*a* is positioned within opening 76 in a manner such that ridges 64*a* prevent rotation of spool 68 relative to support 52*a*. Support 52 is inserted through opening 42 such that hub 58 is aligned with opening 72. Support 52 is translated axially such that hub 58 is positioned within opening 72 in a manner such that ridges 64 prevent rotation of spool 68 relative to support 52. Flaps 40 adjacent panel 26 are moved from the first position, shown in FIG. 6, to the second position, shown in FIG. 3. A user then grabs a napkin 80 on roll 82 adjacent edge 85 in a manner that allows the user to pull the napkin 80 such that at least edge 85 of the napkin 82 extends through slot 46, as shown in FIG. 1.

The user pulls the napkin 80 such that the napkin 80 begins to disengage from roll 82 and more of the napkin extends through slot 46. The napkin 80 is pulled until perforations 84 between the napkin 80 and an adjacent napkin 80 on roll 82 are visible. The user separates the napkin 80 from the adjacent napkin 80 using perforations 84. In some embodiments, this may be accomplished by pulling a corner of the napkin 80 in a direction that is transverse to axis A. In some embodiments, a store employee, such as, for example, a sales associate, may separate a napkin 80 from roll 82 and hand the separated napkin 80 to the user. The separated napkin 80 is placed upon a pillow, such as, for example, upon a panel 96 of one of pillows 86, 88, 90. The user then may rest his or her head upon napkin 80 to test the pillow to determine if it meets the user's criteria. In some embodiments, the user may lie on the mattress when testing the pillow to determine if the pillow provides proper spinal alignment in combination with the mattress. That is, the consumer may lie on the mattress and/or move around on the mattress to determine if the selected pillow is comfortable to the consumer.

The user may then test other pillows having a different configuration than the tested pillow by obtaining an additional napkin 80 for each pillow to be tested in the manner described above. The user may then compare the pillows that were tested based on his or her experience. This process can be repeated with any number of pillows. It is envisioned that after comparing a desired number of pillows, the user will purchase the pillow that he or she believes is most comfortable. For example, the user may purchase the pillow that was most comfortable in combination with a mattress used by the user or a mattress the user intends to use.

The process discussed in the preceding paragraphs may then be repeated any number of times such that a plurality of napkins 80 are dispensed from carton 22 for testing with a plurality of pillows and a plurality of pillows are sold.

In some embodiments, the retailer may compare the number of napkins 80 used, such as, for example, the number of napkins 80 dispensed from carton 22, to the number of pillows sold to determine when to reorder more rolls 82 and/or how many rolls 82 to order. As discussed above, in some embodiments, rolls 82 include a pre-determined number of napkins 80. A retailer may therefore count the number of napkins 80 dispensed from a given roll 82 to determine the number of napkins 80 remaining on roll 82 or may estimate the number of napkins 80 remaining on roll 82 using indicia 26*b*. Likewise, the retailer may count the number of napkins 80 remaining on roll 82 to determine the number of napkins 82 used. In some embodiments, the number of napkins dispensed from spool 68 and/or the number of napkins 80 remaining on spool 68 is determined by counter 75. The retailer may then assess how many napkins 80 were used versus how many pillows were sold to determine how many napkins 80 were used to sell a single pillow, or, alternatively, how many pillows were sold per napkin 80 used by assessing the difference between the number of pillows sold and the number of napkins 80 used. This assessment will assist the retailer in determining how many rolls 82 should be ordered to accommodate a given inventory of pillows. For example, if the retailer determines that three napkins 80 are used per one pillow sold, the retailer will know that he or she should have three times the number of napkins 80 than the number of pillows in his or her inventory. That is, if the retailer has 1000 pillows in inventory and rolls 82 are each pre-loaded with 1000 napkins 80, the retailer will need to order three rolls 82 to accommodate his or her inventory of pillows.

In some embodiments, the number of napkins 80 used may be compared to the number of pillows sold to determine the effectiveness of napkins 80 in marketing pillows. That is, if the number of napkins 80 used exceeds the number of pillows sold, it may be determined that napkins 80 are effective in marketing pillows. If on the other hand, the number of napkins 80 used is less than the number of pillows sold or is less than a certain threshold such as, for example, 25%-50%, it may be determined that napkins 80 are ineffective in marketing pillows. A retailer may then use this information to determine whether or not to continue using napkins 80 to sell pillows.

In some embodiments, retailers have an agreement with a manufacturer and/or wholesaler to use napkins 80 in connection with the sale of pillows, such as, for example, pillows 86, 88, 90. That is, the retailer is obligated under the agreement with the manufacturer and/or wholesaler to use a napkin 80 when a consumer wishes to test a particular pillow to ensure that the retailer is using the manufacturer and/or wholesaler's marketing approach. In some embodiments, the agreement between the manufacturer and/or wholesaler and the retailer requires that the retailer purchase rolls 82 from the manufacturer and/or wholesaler, either on an as needed basis or periodically such as, for example, annually, monthly, bi-monthly, etc. In some embodiments, the agreement between the manufacturer and/or wholesaler and the retailer requires the manufacturer and/or wholesaler to send the retailer rolls 82 to accommodate the retailer's inventory of pillows. It would therefore be beneficial for the manufacturer and/or wholesaler to know if the retailer is indeed using a napkin 80 for each pillow sold to determine if the retailer is following the manufacturer and/or wholesaler's marketing approach. It would also be beneficial for the manufacturer and/or wholesaler to know when the retailer will require more rolls 82 because the retailer is out of napkins 80, is about to run out of napkins 80, has increased their inventory, etc. These and other goals can be achieved using system 20, as discussed below.

Given that the number of rolls 82 purchased by the retailer or provided to the retailer from the manufacturer and/or wholesaler, the size of the retailer's inventory and the number of pillows sold by the retailer are known to both the retailer and the manufacturer and/or wholesaler, either the retailer or the manufacturer and/or wholesaler may compare the number of napkins 80 used against the number of pillows sold by the retailer to determine if the retailer is in fact using a napkin 80 to sell each pillow. For example, if the number of pillows sold by the retailer exceeds the number of napkins used, it would indicate to the manufacturer and/or wholesaler that the retailer is not using a napkin 80 to sell each pillow or is reusing napkins 80. In either case, this would indicate that the retailer is not following the manufacturer and/or wholesaler's marketing approach, as required by the agreement between the retailer and the manufacturer and/or wholesaler. On the other hand, if the number of napkins 80 used matches or exceeds the number of pillows sold, it would indicate that the retailer is using a napkin 80 for each pillow sold and is hence following the manufacturer and/or wholesaler's marketing approach. It is noted that using a number of napkins 80 above and beyond the number of pillows sold would indicate that consumers are testing multiple pillows (each using a napkin 80) for each pillow purchased. Therefore, as discussed above, system 20 may be used to determine if the retailer is in compliance with the agreement between the retailer and the manufacturer and/or wholesaler. Based on the determination if the retailer is in compliance with the agreement between the retailer and the manufacturer and/or wholesaler, the manufacturer and/or wholesaler may terminate the agreement between the retailer and the manufacturer and/or wholesaler. Indeed, it is envisioned that the manufacturer and/or wholesaler may terminate agreements with any retailers that do not follow the manufacturer and/or wholesaler' marketing approach. If on the other hand, the determination is favorable, the manufacturer and/or wholesaler may opt to extend the agreement between the retailer and the manufacturer and/or wholesaler or provide the retailer compensation for following the manufacturer and/or wholesaler's marketing approach such as, for example, one or more free rolls 82. In some embodiments, the manufacturer and/or wholesaler may offer the retailer an opportunity to cure the retailer's defect prior to terminating the agreement between the retailer and the manufacturer and/or wholesaler such as, for example, an opportunity for the retailer to demonstrate compliance with the agreement over a period of time.

In some embodiments, the retailer has a showroom with a door counter that counts the number of people that enter the store. This allows the retailer and/or the manufacturer and/or wholesaler to compare the number of napkins 80 used and the number of people who enter the retailer's showroom. If the number of napkins 80 used is less than the number of people who enter the retailer's showroom, it may indicate that napkins 80 are not being used effectively. That is, it may indicate that the retailer is not using napkins 80 to sell pillows each time the retailer sells a pillow and hence that the retailer is not following the manufacturer and/or wholesaler's marketing approach, as required by the agreement between the retailer and the manufacturer and/or wholesaler. Alternatively, if the number of napkins 80 used is equal to or greater than the number of people who enter the retailer's showroom, it may indicate that napkins 80 are being used effectively. That is, it may indicate that the retailer is using napkins 80 to sell pillows each time the retailer sells a pillow and hence that the retailer is following the manufacturer and/or wholesaler's marketing approach, as required by the agreement between the retailer and the manufacturer and/or wholesaler. In some embodiments, the comparison between the number of napkins 80 used and the number of people who enter the retailer's showroom may be compared with the number of napkins 80 used and the number of people who enter the showroom of at least one other retailer. This allows the manufacturer and/or wholesaler to determine if there is an anomaly with one of the retailers, which may indicate that the comparison of the number of napkins 80 used and the number of people who enter the retailer's showroom is not necessary accurate to determine if the retailer is following the manufacturer and/or wholesaler's marketing approach. On the other hand, if the manufacturer and/or wholesaler determines that data for one particular retailer is not an anomaly, it may indicate that the comparison of the number of napkins 80 used and the number of people who enter the retailer's showroom is accurate to determine if the retailer is following the manufacturer and/or wholesaler's marketing approach.

In some embodiments, the retailer and/or the manufacturer and/or wholesaler may compare the number of napkins 80 used, the number of people who enter the retailer's showroom and the number of the manufacturer's and/or wholesaler's pillows that were sold over a given period of time, such as, for example one month. If the number of napkins 80 used is equal to the number of the manufacturer's and/or wholesaler's pillows that were sold over the given period of time, it may indicate that a napkin 80 is being used to sell each of the manufacturer's and/or wholesaler's pillows and that the retailer is not using napkins 80 to sell pillows that are not made and/or sold by the manufacturer and/or wholesaler. This may indicate that the retailer is following the manufacturer and/or wholesaler's marketing approach, as required by the agreement between the retailer and the manufacturer and/or wholesaler. Alternatively, if the number of napkins 80 used is greater than the number of the manufacturer's and/or wholesaler's pillows that were sold over the given period of time, it may indicate that the retailer is using napkins 80 to sell pillows that are not made and/or sold by the manufacturer and/or wholesaler. This may indicate that the retailer is not following the manufacturer and/or wholesaler's marketing approach, as required by the agreement between the retailer and the manufacturer and/or wholesaler.

In some embodiments, the manufacturer and/or wholesaler may opt to terminate the agreement between the retailer and the manufacturer and/or wholesaler if the manufacturer and/or wholesaler can determine that the retailer is not following the manufacturer and/or wholesaler's marketing approach. In some embodiments, the manufacturer and/or wholesaler may opt to continue or renew the agreement between the retailer and the manufacturer and/or wholesaler if the manufacturer and/or wholesaler can determine that the retailer is following the manufacturer and/or wholesaler's marketing approach.

In some embodiments, the retailer and/or the manufacturer and/or wholesaler may determine how many rolls 82 the retailer has left in inventory by comparing the number of napkins 80 used, the number of pillows sold and the number of rolls 82 previously purchased by the retailer. The manufacturer and/or wholesaler may use this information to determine if and when to send the retailer more rolls 82 and how many rolls 82 to send, if any. The manufacturer and/or wholesaler may use this information to determine if the retailer should be ordering more rolls 82, and if so, how many. Accordingly, this information may be used to determine if the retailer is complying with the agreement between the retailer and the manufacturer and/or wholesaler.

In some embodiments, the retailer and/or the manufacturer and/or wholesaler may determine how many rolls 82 the retailer has left in inventory by comparing the number of napkins 80 used, the number of customers served and the number of rolls 82 previously purchased by the retailer. The manufacturer and/or wholesaler may use this information to determine if and when to send the retailer more rolls 82 and how many rolls 82 to send, if any. The manufacturer and/or wholesaler may use this information to determine if the retailer should be ordering more rolls 82, and if so, how many. Accordingly, this information may be used to determine if the retailer is complying with the agreement between the retailer and the manufacturer and/or wholesaler. In some embodiments, the number of guests served may be determined using a door counter or the like located at the retailer's store or showroom. In some embodiments, the agreement between the retailer and the manufacturer and/or wholesaler requires that the retailer provide each guest that enters the retailer's store or showroom with a napkin 80, regardless of whether the guest does not test a pillow or other bedding.

In some embodiments, an exterior surface of carton 22 includes indicia 100 relating to napkins 80 or pillows to be tested using at least one of napkins 80. For example, indicia 100 may include words directing a consumer to test pillows using napkins 80. In some embodiments, indicia 100 includes words that teach a consumer about pillows sold by a retailer. In some embodiments, indicia 100 includes words that teach a consumer how to choose the pillow that will provide the best spinal alignment based upon the mattress he or she uses and/or his or her body type and/or sleep position preference, for example. In some embodiments, indicia 100 includes words that teach a consumer that using napkins 80 is cleanly and/or teaches the consumer about other benefits of napkins 80. In some embodiments, indicia 100 includes a graphic representation, such as, for example, a photograph, picture or other image that shows a consumer how to use napkins 80 with pillows. For example, indicia 100 may show a person using a napkin 80 with a pillow. In some embodiments, indicia 100 is located on at least one of panels, 26, 28, 30, 32, 34.

Figure 11:
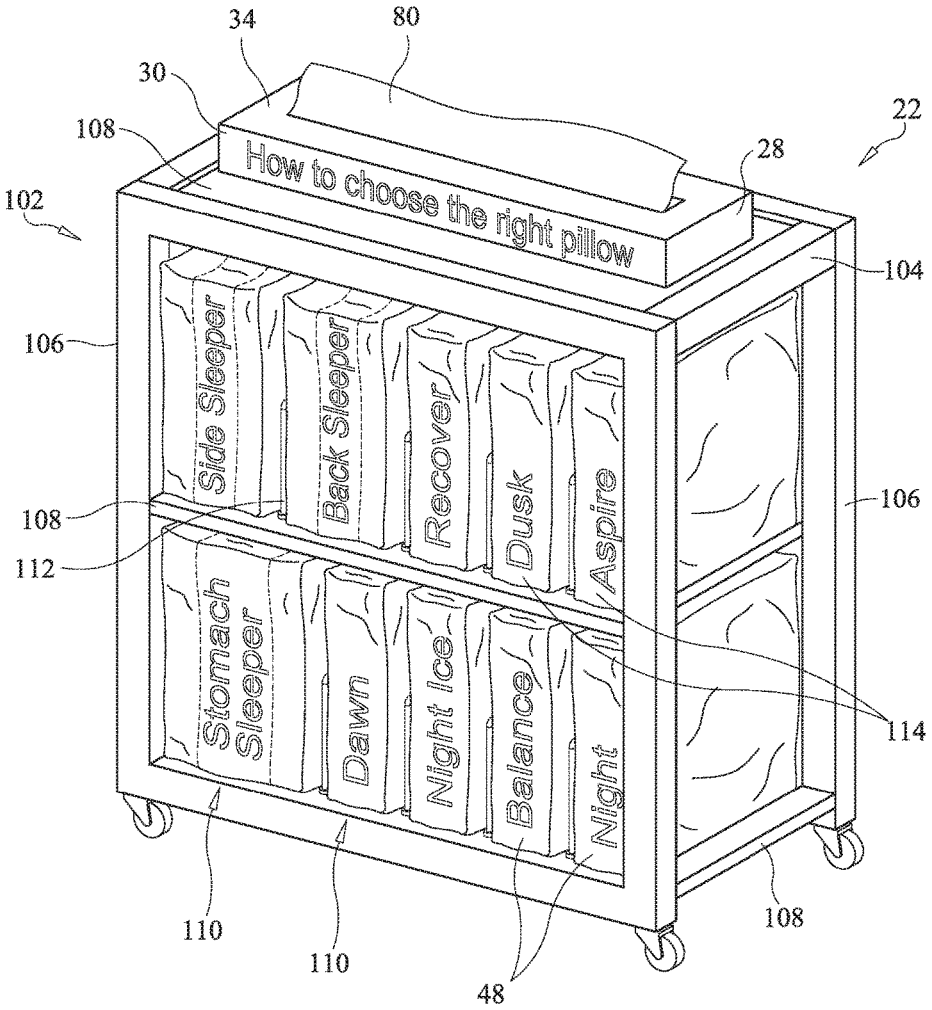
FIG. 11 is a perspective view of components of the system shown in FIGS. 1 and 9 positioned upon an additional component of the system shown in FIG. 1, in accordance with the principles of the present disclosure.

In one embodiment, shown in FIG. 11, system 20 includes a cart 102 comprising a rack 104 comprising a plurality of vertical support members 106 and at least one tray 108 positioned between support members 106. Trays 108 each comprise a plurality of compartments 110 that are separated from one another by a divider 112. A pillow 114, such as, for example, pillows 86, 88, 90 is positioned in one of compartments 110. Carton 22 may be positioned on an uppermost tray 108 such that a consumer can easily access napkins 80 within carton 22. Distal ends of each support member 106 includes a distal face having a caster 116 coupled thereto in order to allow cart 102 to roll on a show room floor, for example. Providing cart 102 with mobility will allow cart 102 to travel between a plurality of mattresses, wherein each of the mattresses have a different configuration.

As discussed above, pillows should be chosen with a particular mattress, and vice versa, in order to achieve proper spinal alignment, and hence the comfort necessary to achieve restful sleep. Cart 102 allows carton 22 on the uppermost tray 108 and the pillows disposed in compartments 110 to be transported from one mattress to another so that a user may test a first mattress with one or more of the pillows disposed in compartments 110 using a napkin for each pillow tested. The user or a sales representative may then transport cart 102 from the first mattress to a second mattress so that the user may test the second mattress with one or more of the pillows disposed in compartments 110 using a napkin for each pillow tested. This process can be repeated for testing with any number of mattresses.

It will be understood that various modifications may be made to the embodiments disclosed herein. For example, features of any one embodiment can be combined with features of any other embodiment. Therefore, the above description should not be construed as limiting, but merely as exemplification of the various embodiments. Those skilled in the art will envision other modifications within the scope and spirit of the claims appended hereto.

What is claimed is:

1. A method of marketing bedding, the method comprising:

providing a carton comprising a plurality of pillow napkins therein;

providing a pillow;

positioning the pillow on a mattress such that an outer surface of the pillow directly engages an outer surface of the mattress;

dispensing one of the pillow napkins from the carton;

positioning the dispensed pillow napkin on the pillow; and positioning a head of a consumer on the dispensed pillow napkin to assess the suitability of the pillow.

2. A method of marketing bedding as recited in claim 1, further comprising:

determining the number of pillows sold; and determining the number of pillow napkins used.

3. A method of marketing bedding as recited in claim 2, further comprising comparing the number of pillows sold and the number of pillow napkins used.

4. A method of marketing bedding as recited in claim 2, further comprising determining the number of pillow napkins remaining in the carton based on the number of pillow napkins used.

5. A method of marketing bedding as recited in claim 1, further comprising:

removing the pillow from the mattress;

positioning a second pillow on the mattress such that an outer surface of the second pillow directly engages the outer surface of the mattress;

dispensing a second one of the pillow napkins from the carton;

positioning the second one of the pillow napkins on the second pillow; and positioning the head of the consumer on the second one of the pillow napkins to assess the suitability of the second pillow.

6. A method of marketing bedding as recited in claim 1, wherein at least one of the pillows comprises a first panel, a second panel and a first gusset joining the first and second panels, the first gusset extending entirely about perimeters of the first and second panels such that the first gusset spaces the first panel apart from the second panel.

7. A method of marketing bedding as recited in claim 6, wherein, the first panel comprises a second gusset that extends in two dimensions in a contour of a surface of the first panel.

8. A method of marketing bedding as recited in claim 6, wherein the pillow napkins each consist of a planar single-layer sheet configured to removably rest upon the first panel without covering the second panel or the first gusset so as to act as a cleanliness barrier for a person's head resting on the pillow.

9. A method of marketing bedding as recited in claim 1, wherein the pillow napkins are formed from materials selected from a group consisting of textile, paper, cellulosic-based materials, and combinations thereof.

10. A method of marketing bedding as recited in claim 1, wherein the pillow napkins are formed from a textile.

11. A method of marketing bedding as recited in claim 1, wherein the pillow napkins are formed from non-woven polyester fibers.

12. A method of marketing bedding as recited in claim 1, wherein the pillow napkins each consist of a single layer planar sheet.

13. A method of marketing bedding as recited in claim 1, wherein the pillow napkins are joined by perforated lines of weakness for easy detachment between each pillow napkin.

14. A method of marketing bedding as recited in claim 1, further comprising providing a cart and positioning the carton atop the cart.

15. A method of marketing bedding as recited in claim 1, wherein the carton is spaced apart from the mattress.

16. A method of marketing bedding, the method comprising:

providing a carton comprising a plurality of walls defining a cavity, a spool positioned in the cavity, and a plurality of pillow napkins wound about the spool;

providing a mattress having opposite first and second sides, the first side defining a sleep surface; positioning a sheet over the mattress such that the sheet entirely covers the first side;

providing a pillow;

positioning the pillow on a sheet such that an outer surface of the pillow directly engages an outer surface of the sheet;

dispensing one of the pillow napkins from the carton;

positioning the dispensed pillow napkin on the pillow; and positioning a head of a consumer on the dispensed pillow napkin to assess the suitability of the pillow.

17. A method of marketing bedding as recited in claim 16, wherein the carton is spaced apart from the mattress.

18. A method of marketing bedding as recited in claim 16, further comprising:

removing the pillow from the mattress;

positioning a second pillow on the mattress such that an outer surface of the second pillow directly engages the outer surface of the sheet;

dispensing a second one of the pillow napkins from the carton;

positioning the second one of the pillow napkins on the second pillow; and positioning the head of the consumer on the second one of the pillow napkins to assess the suitability of the second pillow.

19. A method of marketing bedding as recited in claim 16, wherein the pillow napkins each consist of a single layer planar sheet.

20. A method of marketing bedding, the method comprising:

providing a carton comprising a plurality of walls defining a cavity, the carton comprising only one opening extending through one of the walls, the cavity comprising a plurality of non-folded pillow napkins therein;

providing a pillow;

positioning the pillow on a mattress;

dispensing one of the non-folded pillow napkins from the carton;

positioning the dispensed non-folded pillow napkin on the pillow; and positioning a head of a consumer on the dispensed non-folded pillow napkin to assess the suitability of the pillow.

* * * * *